US007387073B2

(12) United States Patent
Bodley et al.

(10) Patent No.: US 7,387,073 B2
(45) Date of Patent: Jun. 17, 2008

(54) EXPLOSIVE TRAINING DEVICE

(75) Inventors: Brett Bodley, Palouse, WA (US); Andre Baritelle, Palouse, WA (US); Kyle Riebold, Palouse, WA (US)

(73) Assignee: Andre Baritelle, Sequim, WA (US)

( * ) Notice: Subject to any disclaimer, the term of this patent is extended or adjusted under 35 U.S.C. 154(b) by 465 days.

(21) Appl. No.: 11/111,247

(22) Filed: Apr. 20, 2005

(65) Prior Publication Data

US 2006/0236889 A1 Oct. 26, 2006

(51) Int. Cl.
*F42B 8/12* (2006.01)

(52) U.S. Cl. ..... 102/498; 102/487

(58) Field of Classification Search ..... 102/498, 102/482, 487, 368, 355, 502, 529; 446/400, 446/401; 434/11

See application file for complete search history.

(56) References Cited

U.S. PATENT DOCUMENTS 2,094,561 A * 9/1937 Lowy ..... 102/368
3,194,161 A 7/1965 Becker et al.
3,369,486 A 2/1968 Wrennstad et al.
3,492,945 A 2/1970 Filippi
4,932,328 A 6/1990 Pinkney et al.
5,654,523 A * 8/1997 Brunn ..... 102/498
5,824,945 A * 10/1998 Barlog et al. ..... 102/482
6,065,404 A 5/2000 Ripingill, Jr. et al.
6,595,139 B1 * 7/2003 Haeselich ..... 102/498
6,845,715 B2 * 1/2005 Sansolo ..... 102/367
7,083,414 B2 * 8/2006 Sansolo ..... 434/11

* cited by examiner

*Primary Examiner*—James S Bergin
(74) *Attorney, Agent, or Firm*—Wells St. John P.S.

(57) ABSTRACT

An explosive training device is described and which includes a main body defining an internal cavity, and wherein a plurality of elongated channels extend through the main body and communicate with the internal cavity; and an explosive charge is received within the cavity of the main body, and which, when detonated, produces sound and visibly discernible light, and wherein a preponderance of the visibly discernible light, and sound produced by the detonation of the explosive charge escapes from the main body through the plurality of elongated channels.

22 Claims, 1 Drawing Sheet

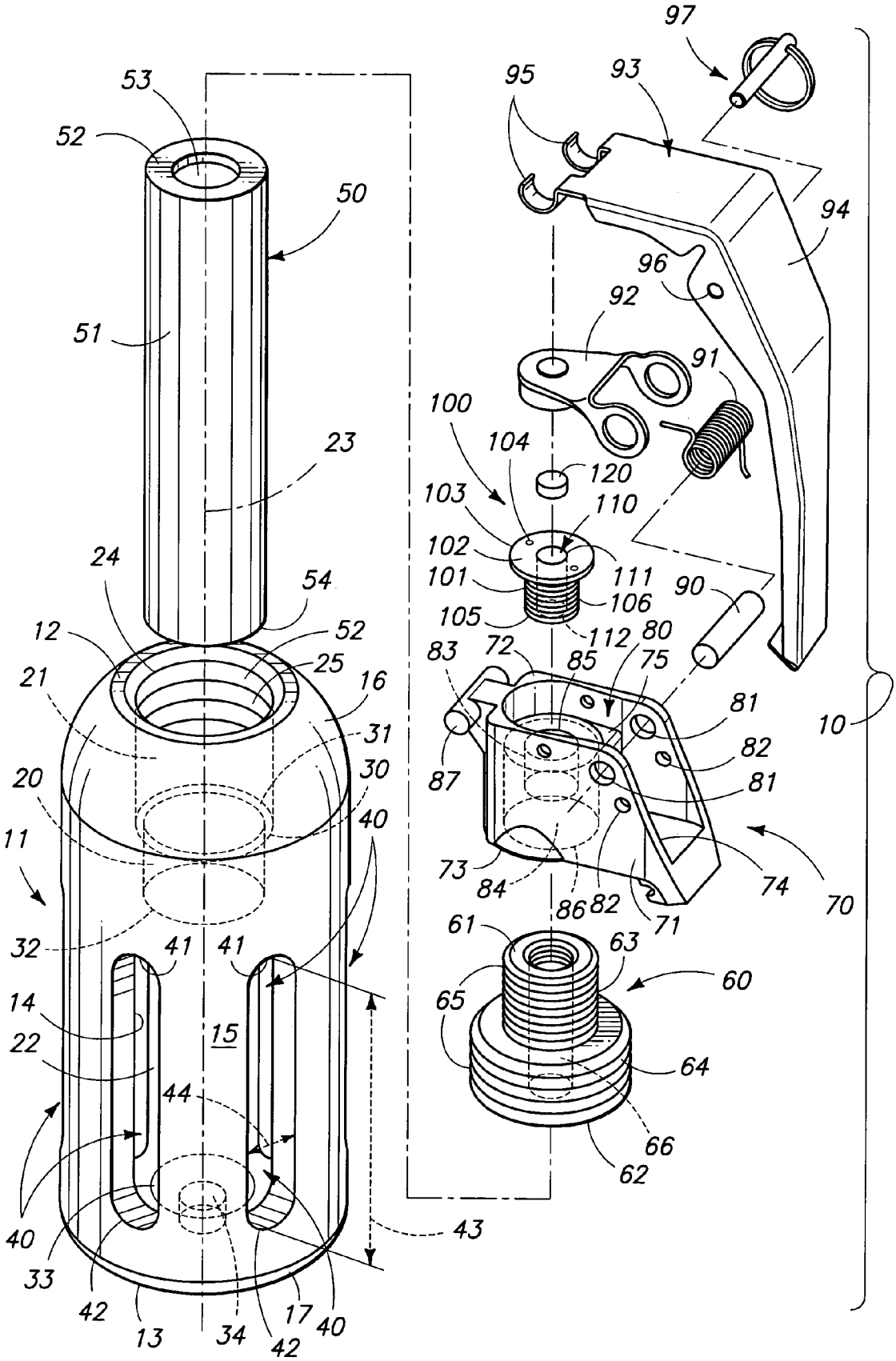
97
95
93
53
52
50
94
96
92
51
91
100
104
120
23
103
110
102
111
24
101
106
90
54
105
112
80
12
52
83
72
85
75
25
21
16
81
10
31
82
87
30
20
81
40
11
73
84
86
82
74
70
71
32
41
41
61
63
60
14
65
15
22
64
44
66
62
40
43
33
42
13
34
42
17
40

EXPLOSIVE TRAINING DEVICE

TECHNICAL FIELD

The present invention relates to an explosive training device, and more specifically to an explosive device which can be utilized in a training environment and which can be readily re-armed and reused on multiple occasions and which produces a realistic sound and visibly discernable light when detonated and which simulates the use of an actual hand grenade or M-84 stun grenade.

BACKGROUND OF THE INVENTION

The prior art is replete with numerous examples of various explosive training devices such as hand grenades, stun grenades, and the like, and which have been utilized to train law enforcement and military personnel over the years. For example, in U.S. Pat. No. 3,194,161 discloses a practice grenade and which is characterized by at least two shell segments which are articulated on a cap and are held in an assembled fashion so as to form a shell by a safety pin. The shell segments are urged to an opened or spreaded condition by spring means which upon removal of the pin become operative to spread the shell segments. The practice grenade carries an ignitable material and all parts with the exception of the cap adjusting spring and certain parts of the igniter can be made out of plastic. In U.S. Pat. No. 3,369,486 a training hand grenade is described and which has a body which is made out of a soft spongy material so as to be harmless to a person which is hit by the device and further has a combustible cartridge to provide an indicating flash when the cartridge is detonated within the soft spongy pliable body material.

U.S. Pat. No. 3,492,945 relates to a practice hand grenade and more specifically to a practice grenade which produces an amount of noise, flash and smoke and which also projects droplets of marker dye in a predetermined pattern so as to permit scoring during training exercises. In this invention, this training device further has a character by which it may be reloaded with dye and pyrotechnic and propellant charges for repeated usage.

U.S. Pat. No. 4,932,328 relates to a reloadable stun grenade, and more specifically to a stun grenade that minimizes the possibility of accidental injury by directing the force of the explosion which is detonated within the grenade out through the ends of the grenade rather than through the sides.

U.S. Pat. No. 5,654,523 relates to a stun grenade which includes a plurality of vents which are defined in the housing and wherein each of the vents is angularly offset from the longitudinal axes of the cavity for discharging explosive energy radially outwardly from the grenade. The stun grenade also includes a bore for receiving a replaceable explosive charge.

U.S. Pat. No. 6,065,404 relates to a training grenade for a multiple integrated laser engagement system (MILES).

While these devices noted above, and others have operated with various degrees of success, they have shortcomings which have detracted from their usefulness. Chief among the problems associated with each of these prior art references is that the training grenades often do not produce enough light, and sound when detonated so as to simulate an actual hand grenade blast. Consequently, personnel, training with such devices are often trained inadequately and carelessly. Efforts to correct the foregoing shortcomings have met with limited success in view of the tendency to design training devices which minimize the possibility of injuring individuals who are utilizing same.

An explosive training device which when detonated produces sound and visibly discernable light which simulates an actual grenade blast, but which minimizes the likelihood of injuring personnel who are handling the explosive device, or who are nearby when it is detonated, is the subject matter of the present invention.

SUMMARY OF THE INVENTION

Therefore, a first aspect of the present invention relates to an explosive training device which includes a main body defining an internal cavity, and wherein a plurality of elongated channels extend through the main body and communicate with the internal cavity; and an explosive charge is received within the cavity of the main body, and which, when detonated, produces sound and visibly discernible light, and wherein a preponderance of the visibly discernible light, and sound produced by the detonation of the explosive charge escapes from the main body through the plurality of elongated channels.

Another aspect of the present invention relates to an explosive training device and which includes a sound projecting body; a removable primer head which cooperates with the sound projecting body; a primer assembly which cooperates with the removable primer head; a spring biased firing pin borne by the removable primer head; a firing pin retaining assembly borne by the removable primer head; and a replaceable explosive charge positioned within the sound projecting body, and which, when detonated, produces sound and light which escape from the sound projecting body.

Still another aspect of the present invention relates to an explosive training device, and which includes a reusable sound and light projecting body which defines an internal cavity and which has a weight which is similar to a standard fragmentary hand grenade and/or M-84 stun grenade, and wherein the main body defines a plurality of substantially equally spaced, and longitudinally extending channels which extend through the sound and light projecting body, and which communicate with the internal cavity; a removable and replaceable explosive charge having an ignitable fuse which is received in the internal cavity, and wherein the replaceable explosive charge has an exterior facing surface area, and wherein at least about 60% of the exterior facing surface area of the replaceable explosive charge is exposed to the ambient environment by way of the plurality of longitudinally extending channels; a removable primer head which releasably threadably couples with the sound and light projecting body, and wherein the removable primer head defines a passageway which extends therethrough, and wherein the passageway has a first end, and an opposite second end which is positioned in spaced relation relative to the ignitable fuse; a single use primer assembly releasably coupled to the removable primer head and oriented in occluding relation relative to the passageway which is defined by the removable primer head, and wherein the single use primer assembly has an outer housing which threadably mates with the removable primer head, and an explosive primer charge which is borne by the outer housing, and which communicates with the passageway which is defined by the removable primer head; a spring biased firing pin borne by the removable primer head and which is operable to strike the explosive primer charge with sufficient force to cause the explosive primer charge to explode, and wherein a portion of the explosion of the explosive primer charge travels along the passageway, as defined by the removable primer head, to cause the fuse of the replaceable explosive charge to ignite and detonate, after a delay of about 1.5 seconds, the replaceable explosive charge; and a selectively releasable firing pin retaining assembly borne by the removable primer head, and wherein a preponderance of the light and sound generated by the detonation of the replaceable explosive charge escapes the sound and light projecting body so as to simulate the use of an actual fragmentary hand grenade in a training environment.

These and other aspects of the present invention will be described in greater detail hereinafter.

BRIEF DESCRIPTION OF THE DRAWING

Preferred embodiments of the invention are described below with reference to the following accompanying drawing.

FIG. 1 is an exploded, perspective, side elevation view of the explosive training device of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

An explosive training device of the present invention is generally indicated by the numeral 10 in FIG. 1. As shown therein, the explosive training device has a reusable sound and light projecting main body 11 and which has a weight which is similar to a standard fragmentary hand grenade and/or M-84 stun grenade, that is it has a weight of less then about 19 ounces, and a length dimension as measured between the first end 12 and second end 13 of less than about four inches. As seen in FIG. 1, the reusable sound and light projecting main body 11 is defined by an interior facing surface 14, and an opposite exterior facing surface 16. As illustrated, the exterior facing surface, in cross-section, is substantially circular, and has a diametral dimension of less than about 2.5 inches. As illustrated in FIG. 1, the region 16 which is most closely adjacent to the first end 12 is substantially frusto-conically shaped. Yet further, the region 17 closest to the second end 13 is somewhat beveled. In the drawing, it will be seen that the interior or inside facing surface 14 defines a cavity 20 which has a first portion 21, and a second portion 22. As seen in the drawing, the main body 11 has a generally longitudinally oriented axes labeled by the number 23. Further, the first portion 21 of the cavity 20 has a proximal end 24. A plurality of threads 25 are formed in the main body 11 near the proximal end 24, and are operable to threadably mate with a primer assembly which will be described in greater detail, hereinafter. In addition to the foregoing, the first portion 21 of the cavity 20 has a distal end 30. As seen in the drawing, the first portion 21 of the cavity has a length dimension and a cross-sectional dimension. The first portion 21 terminates at a seat which is operable to engage in a replaceable explosive charge which will be described hereinafter. The seat has a cross-sectional dimension which is less than the cross-sectional dimension of the distal end 33. As further seen in the drawing, the second portion 22 of the cavity 11 has a proximal end 32 which extends from the seat 31 in the direction of the second end 13 of the main body 11. As illustrated, the first and second portions of the cavity 21 and 22 each have a length and cross-sectional dimension. As illustrated, the cross-sectional dimension of the first portion 21 is greater than the second portion 22. Further, the length dimension of the first portion 21 is less than the length dimension of the second portion 22. In the arrangement as seen in the drawing, the length of the first portion is less than about 2¾ inches. Further, an aperture 34 is formed in the second end 13 of the main body and communicates in fluid flowing relation relative to the distal end 33 of the second portion 22 of the cavity 20.

As seen in the drawing, the sound and light projecting main body 11 defines a plurality of spaced and elongated channels 40 which extend through the main body 11 and which communicate with the second portion 22 of the cavity 20. As illustrated, each of the plurality of elongated channels 40 have a first end 41 and a second end 42. As illustrated, six elongated channels are equally spaced about the main body 11 and generally extend in the direction of the first and second ends 12 and 13 thereof. As shown, each of the plurality of elongated channels have a first end 41 which is spaced from the first end 12 of the main body 11 and an opposite second end 42 which is spaced from the second end 13. The respective elongated channels are disposed in substantially parallel spaced relation relative to the longitudinal axes 23 and further have a length dimension as indicated by the line 43 and which is measured between the first and second ends 41 and 42, and a width dimension generally indicated by the line labeled 44. The length dimension of the respective channels 40 is about equal to the length dimension of the second portion 22 of the cavity 20. As noted earlier, the light and sound projecting main body 11 has a substantially circular cross-sectional shape which is characterized by a circumference dimension. In the arrangement as seen in the drawing, the cumulative width dimension of the plurality of channels 40 is greater than about 40% of the circumference dimension of the main body 11. Still further, the cumulative width dimension of the plurality of channels 40 is greater than the circumference dimension of a replaceable explosive charge 50 which will be described in the paragraph below. As illustrated, the respective elongated channels 40 have length dimensions which are generally less than about 50% of the length dimension of the main body 11 as measured between the first and second ends 12 and 13 thereof, and a width dimension which is less than about 25% of the length dimension 43 of the respective channels.

As seen in the drawing, the present invention 10 includes a replaceable explosive charge which is generally indicated by the numeral 50, and which is received within the cavity 20 and which, when detonated, produces sound and visibly discernable light. In the arrangement as seen, a preponderance of the visibly discernable light and sound produced by the detonation of the explosive charge escapes from the main body 11 through the plurality of elongated channels 40. The explosive training device 10 delivers, upon detonation, a blast having a sound level of about 140 dB. The force of the blast, however, is insufficient to cause the main body to fragment or otherwise create any shrapnel which might injure personnel who are in the region of the main body 11. The replaceable explosive charge 50 has main body 51 with a first end 52. The first end 52 includes an ignitable fuse 53 which is incorporated with same. The fuse, when ignited, after a delay of about 1.5 seconds, is operable to detonate the explosive charge 50. Still further, the main body 51 has an opposite second end 54. The main body has a length dimension as measured between the first and second ends 52 and 54, respectively. This length dimension is typically less than about 2 inches. Still further, the explosive charge has a cross-sectional dimension of less than about 0.6 inches. The explosive charge can be commercially purchased under the trade name "Bird Banger"™. The main body may be fabricated from assorted substances, but typically includes a paper based main body which encloses a fuse and flash powder composition which comprises approximately 5 parts ultrafine 3 micron dark aluminum powder, and 7 parts ultrafine potassium perchlorate powder. The explosive charge 50 has a circumferential dimension. As should be appreciated, in some forms of the explosive charge 50, the circumferential dimension of the main body 51 adjacent to the first end 52 may be greater than the circumferential dimension as measured at the second end 54. In the arrangement as seen, the cylindrically shaped main body 51 of the replaceable explosive charge 50 has a length dimension as measured between the first and second ends 52 and 54, respectively. In the arrangement as illustrated, the elongated channels 40 have a length dimension 43 which is greater than about 50% of the length dimension of the explosive charge 50. Still further, and is noted above, the main body 51 of the explosive charge 50 has a circumferential dimension and further, the width dimension 44 of each of the plurality of elongated channels 40, when additively combined together is greater than the circumference dimension of the explosive charge 50. The circumscribing seat 31 is operable to frictionally engage the first end 52 of the replaceable explosive charge 50 so as to place the first end 52 and more specifically the fuse 53 at the distal end 30 of the first portion 21 of the cavity 20.

As should be understood from the drawing, the explosive charge 50 is operable to substantially occlude the proximal end 32 of the second portion 22 of the cavity 20. When assembled, at least about 70% of the length dimension of the replaceable explosive charge 50 extends into the second portion 22 of the cavity 20. As should be understood from the drawing, the second end 54 of the replaceable explosive charge, when assembled, is disposed in spaced relation relative to the second end 13 of the main body 11. In the present invention, the main body 51 of the replaceable explosive charge has a length dimension which is greater than about the length dimension of the respective elongated channels 40. When fully assembled, the replaceable explosive charge 50 is positioned in the cavity 20 and positioned near but in spaced relation relative to the first end 12. In view of the length and width dimensions of the respective channels 40, in relative comparison to the length and circumferential dimension of the explosive charge 50, a preponderance of the sound, as well as light provided by the detonation of the explosive charge escapes the main body and proceeds generally radially outwardly relative thereto to provide a realistic blast effect which is useful for training purposes. As discussed above, the replaceable explosive charge can be purchased relatively inexpensively commercially under the trade name "Bird Banger"™ from the Reed-Joseph International Company. Typically, this explosive charge is purchased and is fired down range from a single shot launcher. The detonation is used to scare birds and other pests away from crops.

As seen in the drawing, the present invention 10 includes a threaded coupler which is generally indicated by the numeral 60 and which is operable to releasably threadably mate with the first end 12 of the main body 11. As illustrated, the threaded coupler 60 is operable to threadably mate with the first portion 21 of the cavity 20 by threadably mating with the plurality of threads 25 which are formed in the main body and positioned near the first end 12. The threaded coupler 60 has a first end 61 and an opposite second end 62. Still further, the threaded coupler has a first portion 63 which has an outside diametral dimension, and a second portion 64 which has an outside diametral dimension which is greater than the first portion. Each of the first and second portions has a plurality of threads 65 formed therein. Still further, a longitudinally disposed passageway 66 extends from the first end 61 to the opposite second end 62 thereby coupling the first end 61 to the first portion 21 of the cavity. While the threaded coupler 60 is shown as a unitary assembly, it should be understood that the threaded coupler may be formed in a multiple piece unit, that is, the first and second portions may be threadably mated together to form a unitary assembly. In the arrangement as seen, the second portion 64 is threadably received and positioned within the proximal end 24 of the first portion 21 of the cavity. Still further, the first portion 63 extends longitudinally outwardly therefrom and is operable to threadably engage a removable primer head which will be discussed in the paragraph below.

A removable primer head 70 is provided and which releaseably cooperates with the first end 12 of main body 11. In the arrangement as shown, the removable primer head 70 is first removed to facilitate the positioning of the explosive charge 50 within the cavity 20 of the main body 11. Once appropriately positioned within the cavity 20, the explosive charge and more specifically the fuse 53 thereof is positioned in spaced relation relative to the primer head, but is coupled thereto by means of the passageway 66 which is defined by the threaded coupler 60. The removable primer head 70 has a main body 71 which has a proximal end 72 and an opposite distal end 73. As illustrated, the main body defines a pair of spaced sidewalls 74, and an upwardly facing surface 75 is defined or otherwise positioned therebetween the sidewalls 74. A cavity 80 is defined between the pair of spaced sidewalls 74, and the upwardly facing surface 75. As illustrated, a first pair of coaxially aligned apertures 81 are provided in the respective sidewall 74. This first pair of coaxially aligned apertures are designed to receive an axle member and accompanying biasing spring as will be described below. Still further, a second pair of coaxially aligned apertures 82 is provided in the respective sidewalls. This second pair of coaxially aligned apertures is designed to receive a removable pin which is removed prior to the detonation of the apparatus 10. This will also be described in the paragraphs below. As illustrated, the main body 71 has a threaded passageway which extends from the proximal end 72 to the distal end 73. More specifically, the threaded passageway includes a first portion 83 and a second portion of the passageway 84. As seen in the drawing, each of the threaded passageways has a cross-sectional dimension, and wherein the cross-sectional dimension of the second portion of the passageway is greater than the cross-sectional dimension of the first portion thereof. The threaded passageway has a first end 85 and an opposite second end 86. As should be understood, the second portion of the threaded passageway 84 is operable to threadably receive the first portion 63 of the threaded coupler 60. Still further, the main body 71 defines a pivot point 87 which otherwise operates as a spoon engagement member as will be described in greater detail hereinafter.

The removable primer head 70 further includes an axle member which is generally indicated by the numeral 90 which is received within the first pair of coaxially aligned apertures 81 which are formed in the main body 71. Received about the axle member 90 is a biasing spring 91 of conventional design. The biasing spring is operable to engage the main body 71, and is further operable to impart force to a firing pin assembly 92 which rotatably cooperates with the axle member 90, and which rotates substantially along an about 270° arc. The firing pin assembly 92 is operable to strike a primer charge which will be discussed in greater detail hereinafter. The firing pin assembly 92 which rotates about the axle 90 is held in a biased position away from the upwardly facing surface 75 of the main body 71 by a firing pin retaining assembly and which is generally indicated by the numeral 93. This firing pin retaining assembly 93 has a main body 94 which is typically referred to in the art as a "spoon." The spoon 94 has an engagement portion 95 which is operable to engage the spoon engagement members 87 which are positioned on the proximal end 72 of the main body 71. The main body or spoon has a pair of coaxially aligned apertures 96, only one of which is shown, and which are formed in the main body 94. When appropriately positioned to retain the firing pin assembly 92 in an appropriate biased position, the aperture 96 is coaxially aligned with the second pair of apertures 82 which are formed in the main body 71. A ring and pin arrangement 97 is received therethrough in order to secure the firing pin assembly 92 in an appropriate biased position away from the upwardly facing surface 75. Those skilled in the art will recognize that upon removal of the ring and pin 97, and the release of the spoon 94, the biasing spring 92 is operable to cause the main body or spoon 94 to fly away thereby allowing the firing pin assembly 92 to rotate about an arc of about 270° and come into forceable engagement with the upwardly facing surface 75 of the removable primer head 70.

As noted above, the removable primer head 70 defines a passageway having first and second portions 83 and 84 and which extend therethrough, and which has opposite first and second ends 85 and 86 which communicates with one end of the replaceable explosive charge 50. A single use primer assembly is provided and which is generally indicated by the numeral 100. The primer assembly 100 is releasably mounted on the primer head 70 and is further oriented in substantially occluding relation relative to the first end 85, of the passageway, and which when struck by the firing pin assembly 92 ignites the explosive charge 50 thereby detonating same. The single use primer assembly includes a frangible housing or main body which is generally indicated by the numeral 101. The housing or frangible main body may be fabricated from a number of different substances which, after detonation of the primer charge as will be described below, will be rendered unusable again for the same purposes. The housing or main body 101 has a first end 102, and which is further defined by a circumscribing flange 103. Formed in the upwardly facing surface of the circumscribing flange 103 are a pair of wrench engaging cavities 104. These cavities are designed to receive the end of the spanner wrench (not shown) which will allow a user to impart rotational movement to the main body 101. Still further, the housing or main body has an opposite or second end 105 which has a plurality of threads 106 formed therein. The plurality of threads formed in the second end are operable to threadably mate with the first portion 83 of the threaded channel. As illustrated in the drawing, a passageway 110 extends between the first end 102 and the second end 105. The passageway has a first end 111 and an opposite second end 112. A primer charge 120 is received or secured in frictional engagement with, and in substantially occluding relation relative to the first end 111. A primer charge which may be successfully employed is one similar to that which might be used in pistol ammunition or the like. This primer charge, once struck by the firing pin assembly 92 is operable to cause an explosive chain reaction by igniting the fuse 53 which is mounted on the first end 52 of the replaceable explosive charge. As understood from the drawing, the fuse 53 is disposed in spaced relation relative to the primer charge 120, and is coupled thereto by means of the channel 66 and the passageway 110. As noted above, following detonation of the primer charge, the frangible housing or main body 101 is rendered unusable for other purposes. This feature of the invention prevents the assembly 10 from being used for other unlawful purposes, inasmuch as without the single use primer assembly 100, the present invention is completely useless even assuming that the replaceable explosive charge 50 is secured from a commercial source. Once the apparatus 10 has been detonated, the present apparatus may be readily placed back into service by threadably releasing the removable primer head 70 from the main body 11, removing any debris within the cavity 20 and providing a new replaceable explosive charge 50 and placing it within the cavity 20. Further, the user of such a device would remove any debris remaining relative to the frangible housing 101 and would provide a new single use primer assembly 100 which would then be threadably received and coupled to the removable primer head 70. The spring biased firing pin assembly 92 would then be placed back into its biased position, and the firing pin retaining assembly 93 would be placed in covering relation relative thereto. Once this is accomplished, the ring and pin arrangement 97 would be inserted in the coaxially aligned apertures as described above thereby placing the apparatus 10 back into service.

OPERATION

The operation of the described embodiment of the present invention is believed to be readily apparent and is briefly summarized at this point.

The explosive training device 10 of the present invention, as generally seen in the drawing, includes a main body 11 defining an internal cavity 20. The main body includes a plurality of elongated channels 40 which extend through the main body and communicate with the internal cavity. Still further, the explosive training device 10 includes a replaceable explosive charge 50 which is received within the cavity 20 of the main body 11, and which, when detonated, produces sound and visibly discernible light. A preponderance of the visibly discernible light, and sound produced by the detonation of the explosive charge escapes radially outwardly from the main body through the plurality of elongated channels 40 which are provided in same.

The explosive training device 10 of the present invention is operable to provide increased sound and light production upon detonation of a replaceable explosive charge 50. In this regard, the explosive training device 10 includes a sound and light projecting body 11; a removable primer head 70 which cooperates with the sound and light projecting body. Still further, the apparatus 10 includes a single use primer assembly which cooperates with the removable primer head 70; and a spring biased firing pin 92 is borne by the removable primer head. Still further, the apparatus 10 includes a firing pin retaining assembly 93 borne by the removable primer head; and an explosive charge 50 is positioned within the light and sound projecting body 11, and which, when detonated, produces sound and light which escape radially outwardly relative to the sound and light projecting body.

More specifically, an explosive training device 10 as shown in the drawing includes a reusable sound and light projecting body 11 which defines an internal cavity 20 and which has a weight which is similar to a standard fragmentary hand grenade. The main body 11 defines a plurality of substantially equally spaced, and longitudinally extending channels 40 which extend through the sound and light projecting body and which communicate with the internal cavity 20. The assembly as shown in the drawing includes a removable and replaceable explosive charge 50 having an ignitable fuse 53 which is received in the internal cavity 20. The replaceable explosive charge 50 has an exterior facing surface area, and wherein at least about 60% of the exterior facing surface area of the replaceable explosive charge is exposed to the ambient environment by way of the plurality of longitudinally extending channels 40. In addition to the foregoing, the device 10 includes a removable primer head 70 which releasably threadably couples with the sound and light projecting body 11. The removable primer head defines a passageway 83 and 84 which extends therethrough. The passageway 83 and 84 has a first end 85, and an opposite second end 86, which is positioned in spaced relation relative to the ignitable fuse 53. In the arrangement as seen, a single use primer assembly 100 is provided and which is releasably coupled to the removable primer head 70. The single use primer assembly is oriented in occluding relation relative to the passageway 83 and 84 which is defined by the removable primer head. The single use primer assembly 100 has an outer housing 101 which threadably mates with the removable primer head. Still further, an explosive primer charge 120 is provided and which is borne by the outer housing 101, and which communicates with the passageway 83 and 84 which is defined by the removable primer head. In the device as shown in the drawing, a spring biased firing pin 92 is provided and which is operable to strike the explosive primer charge 120 with sufficient force to cause the explosive primer charge to explode, and wherein a portion of the explosion of the explosive primer charge travels along the passageway 83 and 84, as defined by the removable primer head 70, to cause the fuse 53 of the replaceable explosive charge 50 to ignite thereby cause the detonation of the replaceable explosive charge 50. In the arrangement as seen, a selectively releasable firing pin retaining assembly 93 is provided and which is releasably borne by the removable primer head 70. As earlier discussed, a preponderance of the light and sound generated by the detonation of the replaceable explosive charge 50 escapes the sound and light projecting body 11 so as to simulate the use of an actual fragmentary hand grenade in a training environment.

Therefore, it will be seen that the present explosive training device provides many advantages over the assemblies utilized heretofore. The present assembly provides a realistic training device having approximately the same weight, and operation of an actual explosive device such as a fragmentary hand grenade. Still further, the assembly employs a commercially available explosive charge which is readily available on the commercial market and which provides, upon detonation, a significant sound and light, and produces a realistic training environment. Still further, the present device 10 can be readily reloaded, and placed back into service. Additionally, the channels 40 formed in the main body 11 provides for the rather rapid dissipation of pressure formed by the detonation of the replaceable explosive charge 50 thereby minimizing the likelihood that any portion of the present device could be forcibly propelled upon detonation to strike people in the vicinity thereof. Consequently, the present design provides a very economical way for training law enforcement, military and other personnel in the appropriate and safe use of explosive devices such as fragmentary hand grenade in a manner not possible heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An explosive training device, comprising:

a main body defining an internal cavity, and wherein a plurality of elongated channels extend through the main body and communicate with the internal cavity;

an explosive charge received within the cavity of the main body, and which, when detonated, produces sound and visibly discernible light, and wherein a preponderance of the visibly discernible light, and sound produced by the detonation of the explosive charge escapes from the main body through the plurality of elongated channels;

a removable primer head which releasably cooperates with one end of the main body of the explosive training device, wherein the removable primer head is first removed to facilitate the positioning of the explosive charge within the cavity of the main body, wherein the explosive charge is positioned adjacent to the end of the main body of the explosive training device which cooperates with the removable primer head, wherein the removable primer head defines a passageway which extends therethrough and which has opposite first and second ends, and wherein the passageway communicates with one end of the explosive charge;

a single use primer assembly which is releasably mounted on the primer head and which is oriented in substantially occluding relation relative to the first end of the passageway, wherein the single use primer assembly has an outer housing which releasably mechanically cooperates with the primer head; and a primer charge borne by the outer housing of the single use primer assembly, which, when struck, causes the ignition of the explosive charge, wherein the outer housing of the primer assembly is rendered unusable by the ignition of the of the primer charge after a single use.

2. An explosive training device as claimed in claim 1, and wherein the main body is elongated, and has opposite first and second ends, and a longitudinally oriented axis, and a length dimension as measured between the opposite first and second ends, and wherein each of the elongated channels has a length dimension which is less than about 50% of the length dimension of the main body, and a width dimension which is less than about 25% of the length dimension of the respective channels.

3. An explosive training device as claimed in claim 1, and wherein each of the respective elongated channels have a length dimension, and wherein the explosive charge received in the cavity of the main body has a cylindrically shaped main body which has a length dimension, and wherein the length dimension of the respective elongated channels is greater than about 50% of the length dimension of the explosive charge.

4. An explosive training device as claimed in claim 1, and wherein each of the respective elongated channels has a width dimension, and wherein the explosive charge received in the cavity of the main body has a cylindrically shaped main body which has a circumference dimension, and wherein the width dimension of each of the plurality of the elongated channels when additively combined together is greater the circumference dimension of the explosive charge.

5. An explosive training device as claimed in claim 1, and further comprising:

a spring biased firing pin borne by the removable primer head; and a selectively releasable firing pin retaining assembly borne by the removable primer head assembly.

6. An explosive training device as claimed in claim 1, and wherein the main body of the explosive trainer has a length dimension, and wherein the explosive charge has a length dimension of less than about one-half of the length dimension of the main body.

7. An explosive training device as claimed in claim 1, and wherein the main body has a length dimension of less than about 4 inches; a cross sectional dimension of less than about 2.5 inches; and a weight of less than about 19 ounces.

8. An explosive training device as claimed in claim 1, and wherein the explosive training device delivers, upon detonation, delivers a blast having a sound level of about 140 dB.

9. An explosive training device as claimed in claim 1, and wherein the removable primer head further comprises a separate coupler which releasably cooperates with one end of the main body and through which a portion of the passageway extends to the second end.

10. An explosive training device, comprising:

a sound projecting body;

a removable primer head which cooperates with the sound projecting body, wherein the removable primer head defines a passageway which extends therethrough;

a single use primer assembly releasably coupled to the removable primer head and oriented in occluding relation relative to the passageway defined by the removable primer head, wherein the single use primer assembly has an outer housing which threadably mates with the removable primer head and has an explosive primer charge which is borne by the outer housing and which communicates with the passageway defined by the removable primer head;

a spring biased firing pin borne by the removable primer head;

a firing pin retaining assembly borne by the removable primer head; and a self-contained, replaceable explosive charge, including an ignitable fuse material, positioned within the sound projecting body, and which, when detonated, produces sound and light which escape from the sound projecting body, wherein the passageway defined by the removable primer head provides an unobstructed path therethrough from the primer charge toward the ignitable fuse material.

11. An explosive training device as claimed in claim 10, and wherein the sound projecting body has a length and width dimension, and wherein the length dimension is greater than the width dimension, and wherein the sound projecting body has a first and an opposite, second end, and wherein a cavity is defined by the main body and extends from the first end in the direction of the second end, and wherein the replaceable explosive charge is positioned in the cavity and near the first end.

12. An explosive training device as claimed in claim 11, and wherein the cavity is defined by a first portion which extends from the first end in the direction of the second end, and wherein the main body defines a seat which engages the replaceable explosive charge, and wherein the first portion of the cavity terminates at the seat, and wherein the cavity defines a second portion which extends from the seat in the direction of the second end, and wherein the first and second portions of the cavity each have a length and cross sectional dimension, and wherein the cross sectional dimension of the first portion is greater than second portion, and wherein the length dimension of the first portion is less than the length dimension of the second portion.

13. An explosive training device as claim 11, and wherein the sound projection body further defines a plurality of spaced, elongated channels which extend through the sound projecting body, and communicate with the second portion of the cavity, and wherein each of the elongated channels generally extend in the direction of the first and second ends, and wherein the plurality of elongated channels each have a length and width dimension, and wherein the length dimension of the respective channels are about equal to the length dimension of the second portion of the cavity.

14. An explosive training device as claimed in claim 13, and wherein the replaceable explosive charge has a generally cylindrically shaped main body which has a first end that includes the ignitable fuse, and a distal second end, and wherein the main body of the replaceable explosive charge has a length dimension which is greater than about the length dimension of the respective elongated channels, and wherein the seat engages the first end of the replaceable explosive charge so as to render the ignitable fuse accessible from the first portion of the cavity, and wherein at least about 70% of the length dimension of the replaceable explosive charge extends into the second portion of the cavity, and wherein the second end of the replaceable explosive charge is disposed in spaced relation relative to the second end of the sound projecting body.

15. An explosive training device as claimed in claim 14, and wherein the plurality of channels are substantially equally spaced about the sound projecting body, and wherein the sound projecting body has a substantially circular cross-sectional shape and which is characterized by a circumference dimension, and wherein the cumulative width dimension of the plurality of channels is greater than about 40% of the circumference dimension.

16. An explosive training device as claimed in claim 15, and wherein the cylindrically shaped main body of the replaceable explosive charge has a circumference dimension, and wherein the cumulative width dimension of the plurality of channels is greater than the circumference dimension of the replaceable explosive charge.

17. An explosive training device as claimed in claim 14, and wherein the removable primer head mechanically cooperates with the first end of the sound projecting body and is received in part in first portion of the cavity, and wherein the removable primer head is removed to insert the replaceable explosive charge within the cavity, and wherein the passageway has a first end, and an opposite second end which is disposed in spaced relation relative to the fuse of the replaceable explosive charge.

18. An explosive training device as claimed in claim 17, and wherein the outer housing of the primer assembly is frangible, and wherein the primer charge, when struck by the spring biased firing pin, is effective to ignite the fuse and detonate the replaceable explosive charge, and wherein the primer charge explodes upon impact with the spring biased firing pin, and wherein the explosion of the primer charge renders the frangible outer housing unusable.

19. An explosive training device as claimed in claim 18, and wherein a preponderance of the sound and light generated by the detonation of the replaceable explosive charge escapes from the cavity of the sound projecting body.

20. An explosive training device as claimed in claim 10, and wherein the removable primer head further comprises a separate coupler which cooperates with the sound projecting body and through which a portion of the passageway extends.

21. An explosive training device, comprising:

a reusable sound and light projecting body which defines an internal cavity and which has a weight which is similar to a standard fragmentary hand grenade, and wherein the main body defines a plurality of substantially equally spaced, and longitudinally extending channels which extend through the sound and light projecting body and which communicate with the internal cavity;

a removable and replaceable explosive charge having an ignitable fuse which is received in the internal cavity, and wherein the replaceable explosive charge has an exterior facing surface area, and wherein at least about 60% of the exterior facing surface area of the replaceable explosive charge is exposed to the ambient environment by way of the plurality of longitudinally extending channels;

a removable primer head which releasably threadably couples with the sound and light projecting body, and wherein the removable primer head defines a passageway which extends therethrough, and wherein the passageway has a first end and an opposite second end which is positioned in spaced relation relative to the ignitable fuse;

a single use primer assembly releasably coupled to the removable primer head and oriented in occluding relation relative to the passageway which is defined by the removable primer head, and wherein the single use primer assembly has an outer housing which threadably mates with the removable primer head, and an explosive primer charge which is borne by the outer housing, and which communicates with the passageway which is defined by the removable primer head;

a spring biased tiring pin borne by the removable primer head and which is operable to strike the explosive primer charge with sufficient force to cause the explosive primer charge to explode, and wherein a portion of the explosion of the explosive primer charge travels along the passageway, as defined by the removable primer head, to cause the fuse of the replaceable explosive charge to ignite and detonate the replaceable explosive charge; and a selectively releasable firing pin retaining assembly borne by the removable primer head, and wherein a preponderance of the light and sound generated by the detonation of the replaceable explosive charge escapes the sound and light projecting body so as to simulate the use of an actual fragmentary hand grenade and/or M-84 stun grenade in a training environment.

22. An explosive training device as claimed in claim 21, and wherein the outer housing is frangible.

* * * * *

UNITED STATES PATENT AND TRADEMARK OFFICE

CERTIFICATE OF CORRECTION

PATENT NO. : 7,387,073 B2
APPLICATION NO. : 11/111247
DATED : June 17, 2008
INVENTOR(S) : Brett Bodley, Andre Baritelle and Kyle Reibold It is certified that error appears in the above-identified patent and that said Letters Patent is hereby corrected as shown below:

Claim 21, Column 14, line 11, replace "a spring biased tiring pin" with --a spring biased firing pin--.

Signed and Sealed this

Eleventh Day of November, 2008

JON W. DUDAS
*Director of the United States Patent and Trademark Office*